US007075043B2

(12) United States Patent
Howard et al.

(10) Patent No.: US 7,075,043 B2
(45) Date of Patent: Jul. 11, 2006

(54) STANDOFF FOR USE WITH UNCOILED BARE WIRE AND INSULATED RUNS OF AN OPEN COIL ELECTRIC RESISTANCE HEATER, METHOD OF USE, AND AN OPEN COIL RESISTANCE HEATER USING THE STANDOFF

(75) Inventors: H. Keith Howard, Cookeville, TN (US); James L. Sherrill, Cookeville, TN (US)

(73) Assignee: Tutco, Inc., Cookeville, TN (US)

( * ) Notice: Subject to any disclaimer, the term of this patent is extended or adjusted under 35 U.S.C. 154(b) by 107 days.

(21) Appl. No.: 10/879,286

(22) Filed: Jun. 30, 2004

(65) Prior Publication Data

US 2006/0000824 A1 Jan. 5, 2006

(51) Int. Cl.
*H05B 3/06* (2006.01)

(52) U.S. Cl. ..... 219/548; 219/536

(58) Field of Classification Search ..... 219/548, 219/542, 546, 532, 536, 537; 338/304–305, 338/296, 315, 317, 321
See application file for complete search history.

(56) References Cited

U.S. PATENT DOCUMENTS

| | | | | | |
|---|---|---|---|---|---|
| 4,531,017 | A | * | 7/1985 | Sherrill | 174/138 J |
| 4,628,189 | A | * | 12/1986 | Danko | 219/532 |
| 4,675,511 | A | * | 6/1987 | Sherrill | 219/532 |
| 5,124,534 | A | * | 6/1992 | Williams et al. | 219/532 |
| 5,329,098 | A | | 7/1994 | Howard et al. | |
| 5,578,232 | A | * | 11/1996 | Engelke | 219/532 |
| 5,895,597 | A | | 4/1999 | Sherrill | |
| 5,925,273 | A | | 7/1999 | Sherrill | |
| 5,959,254 | A | * | 9/1999 | Martin, Sr. | 174/138 J |
| 6,285,013 | B1 | * | 9/2001 | Holmes | 219/536 |
| D495,298 | S | * | 8/2004 | Keathley | D13/117 |

* cited by examiner

*Primary Examiner*—Robin Evans
*Assistant Examiner*—Vinod Patel
(74) *Attorney, Agent, or Firm*—Clark & Brody

(57) ABSTRACT

An open coil resistance heater uses one or more standoffs to engage and support the generally straight or uncoiled run of bare or insulated wire that is part of the resistance wire of the heater. The standoff has slots, which are sized to engage the bare or insulated wires for support purposes, and is removably mountable to the heater frame for supporting the run of uncoiled wire.

22 Claims, 5 Drawing Sheets

STANDOFF FOR USE WITH UNCOILED BARE WIRE AND INSULATED RUNS OF AN OPEN COIL ELECTRIC RESISTANCE HEATER, METHOD OF USE, AND AN OPEN COIL RESISTANCE HEATER USING THE STANDOFF

FIELD OF THE INVENTION

The present invention is directed to a standoff for use in an open coil electric resistance heater, and in particular to a standoff that engages uncoiled portions of the electrical resistance wire of the heater to minimize shorting or grounding conditions.

BACKGROUND ART

The use of a single resistance wire formed into a helical coil for use in electric resistance heating either for heating moving air, for radiant heating or for convection heating is well known in the prior art. In one type of heater, the resistance coils are energized to heat air passing over the coils, the heated air then being directed in a particular manner for heating purposes. One application using such a heater is an electric clothes dryer.

Examples of open coil heaters are found in U.S. Pat. Nos. 5,329,098, 5,895,597, and 5,925,273, all owned by Tutco, Inc. of Cookeville, Tenn. Each of these patents is incorporated by reference in its entirety herein. One type of an open coil electric resistance heater is a two stage heater described in U.S. Pat. No. 5,925,273. A side view of this type of heater is shown in FIG. 1 and designated by the reference numeral 10. The heater 10 has two heater elements 10*a* and 10*b*, optimally for use in a clothes dryer. The elements 10*a* and 10*b* are supplied with electricity via terminals 12 extending from the terminal block 28. The heater elements 10*a*, 10*b* are supported by a metal plate 14, which in turn supports a plurality of support insulators 16, which are well known in the art. The support insulators 16 support and isolate coiled portions of the elements, 10*a* and 10*b*, during operation of the heater.

The heater 10 includes opposing sidewalls (one shown as 6 in FIG. 1), wherein projections in the plate 14 extend through slots 20 in the sidewall 6 to allow the sidewalls to support the plate.

Each of the electric heater elements, 10*a* and 10*b*, is arranged in series of electrically continuous coils which are mounted on the plate 14 in a spaced-apart substantially parallel arrangement. Each heater assembly 10*a* and 10*b* is arranged substantially equally and oppositely on both sides of the plate. Crossover portions 22*a* and 22*b* of each heater element 10*a* and 10*b* are provided wherein each crossover links one coil of each of the elements mounted on one side of the plate 14 with another coil of the same element found on the other side of the plate. The plate 14 has several cutout portions (not shown) to provide adequate clearance for the crossover portions, 22*a* and 22*b*, and the anticipated drooping or sagging movement of such portions.

Electricity is supplied to the heater assembly through the terminal block 28. The heater elements, 10*a* and 10*b*, are arranged so that the terminal connector portions or wire leads 32 and 34 which extend from an end 38 of each of the mounted coil sections to the terminal block are as short as possible. This aids in eliminating or reducing the need for supporting the connector portions. For the longer runs, the wire leads, 32 and 34, are partially enclosed with an insulating member 36. The insulating member 36 may be formed from any type of insulating material suitable for this purpose, e.g., a ceramic type. The insulating member is generally tubular in shape and rigid.

One of the most significant aspects of the open coil heater design is that of routing the uncoiled connector portions extending from the ends of heater coils (resistance wire leads) so they are protected from contact with either adjacent live heater wire sections or from contact with bare metal, either of which creates a potential failure. The resistance wire leads for connecting to the termination point(s) for ultimate connection to a source of electrical power must therefore be routed and protected from dead metal and from electrically live parts of a different polarity than the resistance wire leads. When physical separation cannot be achieved using design techniques available to the technology, the prior art, as noted above, has used insulating tubes made of appropriate materials for the application, e.g., ceramic tubes are used for routing and isolating the resistance wires lead, see items 36 in FIG. 1.

However, the mere use of ceramic tubes alone to protect the resistance wire leads does not always solve all of the problems in these types of heaters. The manufacturing of open coil heaters that use insulating tubes to protect a length of bare resistance wire lead section often requires more than one tube section for each wire lead. That is, to span longer sections it is necessary to use multiple tube pieces. At the point where two tubes meet there is, of course, a narrow opening and when electrical spacing requirements per safety standards are considered, the opening can be or is significant. The same condition may exist at the free end of a ceramic tube, i.e. where there is no adjacent tube. Even under the best of conditions there are over-the-surface and through-the-air distance conditions occurring where an electric potential exists. This electrical potential could result in either a ground out or an electrical short should movement occur, both of which are dangerous conditions to be avoided.

There are practical reasons why multiple tubes may be required to span one section of bare resistance wire. The first is that longer sections of insulating tubes are more expensive to manufacture than shorter sections, so that using a number of shorter sections may be more economical.

Another reason that longer tubes are shunned is that shipping and handling relatively long tubes during heater assembly result in damage or breakage. Further it is often more economical to have available multiple short pieces that are of a lower cost per unit length in order to accommodate various length requirements than to have exact lengths made for every requirement. A given length requirement can be fulfilled by using two or more short pieces of insulating tubes to span the longer required distance.

Even when a single insulating tube is of sufficient length to span the distance from the end of the heating coil to the termination point, there may be lack of clearance at a tube end between the wire exiting the tube and adjacent dead metal. A further problem results should a tube break and the result is another potential electrical short or ground out condition being created.

It is also impractical to use an insulating tube with a wall thickness great enough to overcome the dangerous electrical conditions noted above. Thick walled tubes are costly to produce and handle during the manufacture of open coil heaters.

In the art of open coil heaters, separate tabs, clips, straps or stand-offs made of metal have been used to position and permanently restrain the insulating tubes containing resistance wires as described above. However, this method of restraint often creates mechanical stress resulting in tube breakage. Though a break in the tube in itself doesn't mean the wires will move from their intended routing, a possible electrical short or a ground condition may result as an effect of the wire contacting the above described metal restraining means.

In light of the shortcomings in protecting the bare wire leads or the problems when using ceramic leads of open coil electric resistance heaters, a need has developed for improved ways to minimize the possibility of shorting or grounding conditions. The present invention responds to this need by providing a standoff for use with the resistance wire leads or other uncoiled runs to minimize these grounding/shorting conditions.

SUMMARY OF THE INVENTION

It is a first object of the invention to provide an improved open coil resistance heater.

It is another object of the invention to provide an open coil resistance heater that uses one or more standoffs that support uncoiled wire runs, particularly wire leads of the heater.

Yet another object of the invention is a standoff for use with an open coil heater or other type of heater whereby the standoff can engage wire runs, particularly wire leads, of the heater to protect them from shorting/grounding in the run.

One further object of the invention is an improvement in methods of providing heat using electric resistance heaters, wherein the heater includes one or more standoffs for the heater's uncoiled wire, particularly wire leads, to minimize shorting or grounding conditions.

Other objects and advantages will become apparent as a description of the invention proceeds.

In satisfaction of the foregoing objects and advantages of the invention, the invention is an improvement in heaters employing open coil electric resistance elements. More particularly, the invention involves heaters that contain one or more runs of uncoiled or generally straight wire runs. A given run may extend between two coiled portions of the heater element. Alternatively, the run may extend between the coiled portion of the heating element and a terminal block or the like that is adapted for connection to a source of power, this run forming a wire lead to assist connecting the resistance wire to a supply of power. The coiled portion of the resistance wire element is supported by a plurality of insulators, with the plurality of insulators being supported by a frame. The invention is the use of one or more standoffs that are made of electrically insulating material. Each standoff further comprises a standoff body including means for mounting the body to the frame. Each standoff body has at least one slot sized to engage and support a portion of the run of uncoiled wire, either in a bare state or in an insulated state. If the heater employs a pair of runs that require support, the standoff body can be configured to have a pair of slots to accommodate the pair of wire runs. The slots can be sized to support either bare wire or insulated wire. The standoff is especially adapted for two stage heaters, wherein the heating element most remote from the terminal block has long runs of wire that can use one or more standoffs for support.

In one embodiment, the standoff can be used with insulated wire leads wherein the insulation is positioned adjacent the standoff such that the standoff is supporting a bare wire run and offering an insulating effect on the bare wire run as well.

The means for mounting the standoff can involve any number of mounting configurations from fasteners, to specially configured slots in the heater frame, to adhesives or combinations thereof. In one mode, the mounting means comprises a pair of opposing slots in the standoff body, and a cutout in the frame. Each slot engages a respective portion of the frame adjacent the cutout for mounting, a portion of the frame including a tab adjacent to one of the respective portions of the frame. To secure the standoff, the tab can be bent to retain the standoff in the cutout. Depending on the length of the uncoiled wire run, more than one cutout and standoff can be utilized for wire run support. The cutout can be shaped to allow for rotation of the standoff for mounting purposes, and/or sized to allow for both standoff rotation and crossover wire passage to link coils on opposite sides of the frame.

The invention also entails an improvement in a method of heating using an open coil electric resistance heater, wherein the heater has at least one resistance wire element for heating, a coiled portion of the resistance wire element being supported by a plurality of insulators, with the plurality of insulators being supported by a frame, the wire element including one or more uncoiled wire runs that require support. The run or runs can be the uncoiled bare or insulated wire leads beginning at coiled portions of the wire element and terminating in a pair of uncoiled bare wire leads for connection to a source of power via a terminal mounted to the heater. As noted above, the uncoiled runs, bare or insulated can also extend between two coiled portions of the resistance wire element. As part of this method, at least one resistance wire element is energized to generate heat, either via radiation or convection. The improvement in the method comprises supporting the bare or insulated wire runs using at least one standoff made of the electrically insulating material that is mounted to the frame and positioned so as to support one or more uncoiled wire runs.

BRIEF DESCRIPTION OF THE DRAWINGS

Reference is now made to the drawings of the invention wherein.

DESCRIPTION OF THE PREFERRED EMBODIMENTS

The invention offers advantages in the field of open coil resistance heaters in that the problems in grounding or shorting as a result of wire leads or other uncoiled wire runs coming into contact with dead metal or the like are significantly reduced. This improvement is achieved by using a standoff to support the uncoiled wire runs that extend between the coiled resistance wires and terminals for later connection to a power source.

Figure 1:
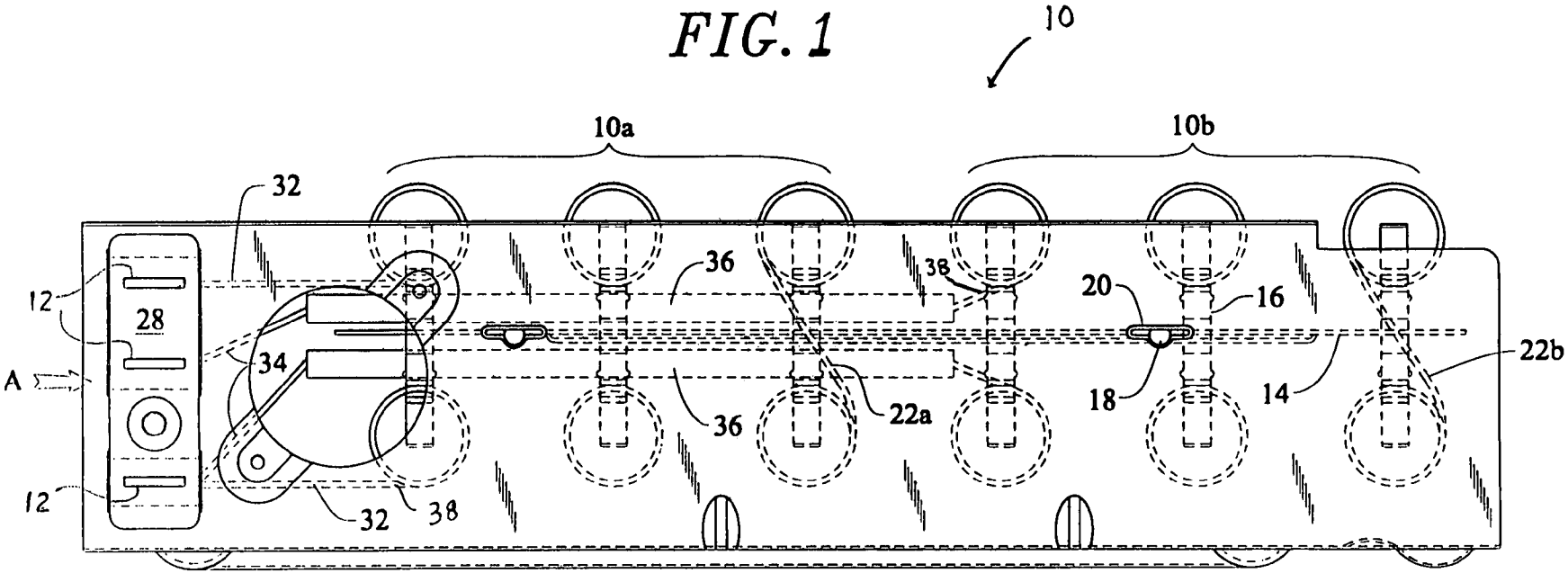
FIG. 1 is a side view of a prior art open coil electric resistance heater.
Figure 2:
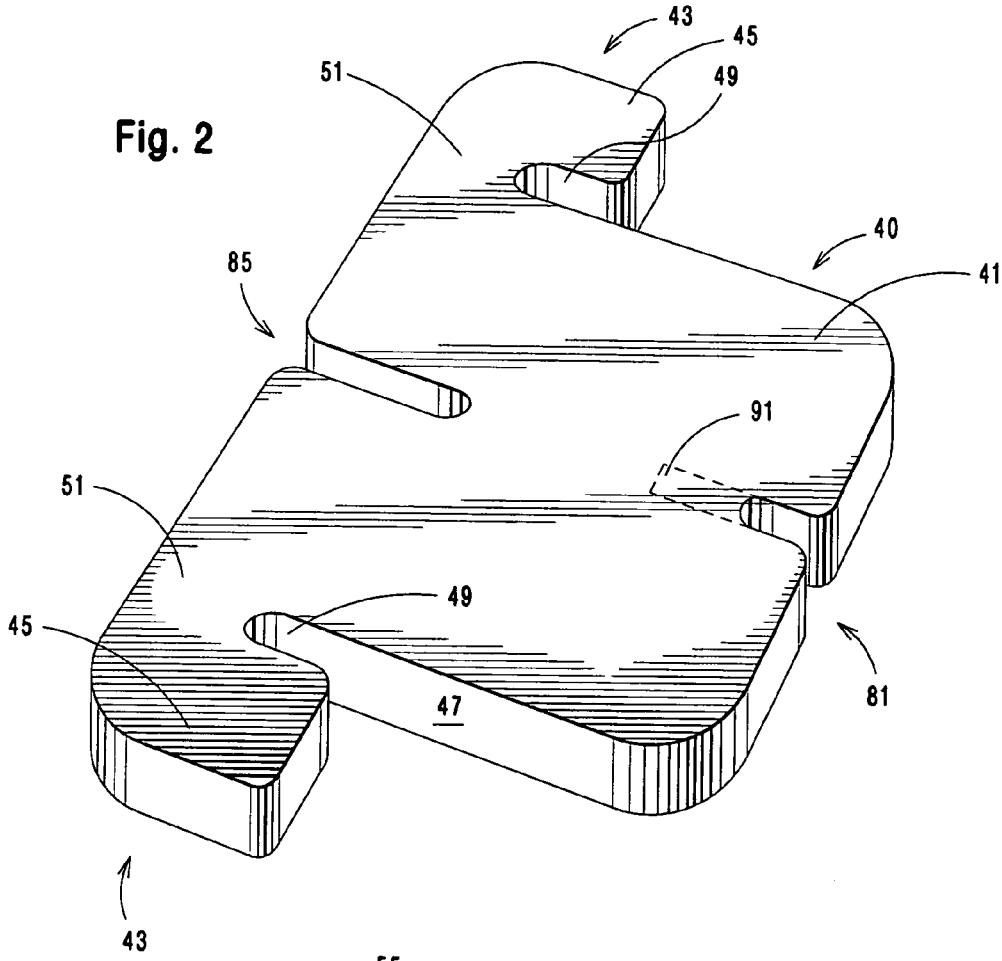
FIG. 2 is a perspective view of the standoff of FIG. 2.

One embodiment of the standoff aspect of the invention is illustrated in FIG. 2, and is designated by the reference numeral 40. The standoff 40 includes a generally rectangular standoff body 41 having a pair of L-shaped arms 43, each extending from one side of the body 41. Each free end 45 (the longer leg of the L-shaped arm) of the arms 41 coupled with a portion of the side face 47 of the body 41 forms a slot 49. The length of the slot is determined by the thickness of the body 41. The width of the slot is determined by the length of the shorter leg 51 of the L-shaped arm 43. The depth of the slot 49 is controlled by the length of the longer leg 45 of the L-shaped arm 43. In the embodiment depicted in FIG. 2, each slot 49 is sized to engage bare resistance wire. However, the slot 49 could be made bigger to engage an insulated resistance wire, such as one that is surrounded by a ceramic tube as shown in FIG. 1. This could be accomplished by making the shorter leg portion 51 longer, thus increasing the distance between the side face 47 and free end leg 45.

Figure 3:
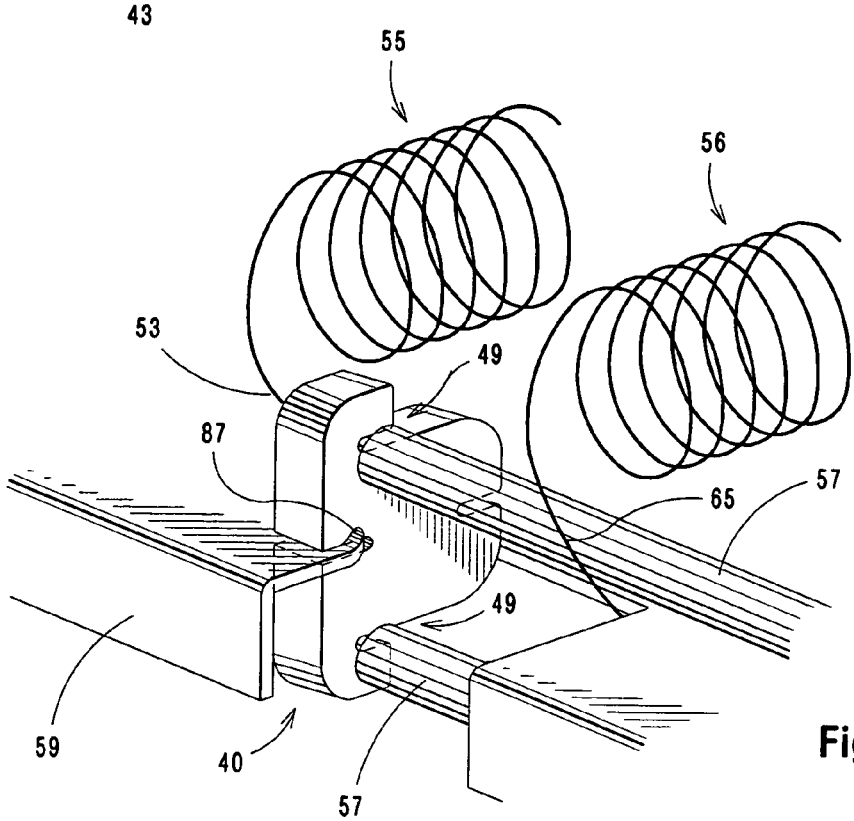
FIG. 3 is a perspective view of a portion of an open coil electric resistance heater using a standoff for wire lead support.

Referring to FIG. 3, a perspective view of a portion of a two stage heater is shown, wherein a coiled portion 55 from one stage and a second coiled portion 56 from another stage are shown schematically. The standoff 40 is shown supporting a bare wire lead 53 that extends from the coiled portion 55. Adjacent to the standoff 40 is an insulator tube 57 that surrounds the bare wire lead 53 and terminates at the terminal (not shown). Although not shown, the wire lead of other coiled portion positioned beneath frame 59 extends through the other slot 49 in the standoff and the other insulator tube 57 in route to the terminal block.

The straight wire lead 53 is one end of the electric resistance element used in one stage of the two stage heater, akin to element 10*b* of FIG. 1 and its wire lead 32. As is evident from FIG. 1, the element 10*b* furthest removed from the terminal block 28 has the longest runs of uncoiled wire leads, with the pair of wire leads for the heating element disposed on either side of the frame. In these types of heaters and as noted above, the standoff 40 has opposing slots 49 to support each uncoiled wire lead of the heating element, one on either side of the frame 59. When using the standoff to support bare wire leads that also use insulation such as the tubes 57 shown in FIG. 3, the exposed portion of the wire lead is further minimized by the insulating coverage provided by the slot 49.

While FIG. 3 shows the standoff 40 supporting bare wire leads adjacent to wire lead encased in an insulator tube, the standoff 40 could be used to support one, or a pair of bare wire leads that are not insulated at all. As mentioned above, the standoff could also support the insulated wire lead rather than the bare wire lead, with the slot or slots sized appropriately to accommodate the insulation. Also, the standoff could be used in heaters that would employ only one run of bare lead wire, such that only one slot would be needed for wire lead support.

FIG. 3 also illustrates a crossover 65 which links the coil portion 56 to another coiled portion disposed on the other side of the frame 59 as part of the other element of the two elements making up the two stage heater.

The standoff is made from electrically insulating material, and can be virtually any type that would achieve this insulating purpose. Preferred materials are ceramic materials, similar to the materials used as support insulators for the coils of the heaters as described in the Tutco patents mentioned above. The standoffs can be made in any known manner.

The standoff embodiment of FIGS. 2 and 3 also includes means for mounting the standoff 40 to the frame 59 of a heater, the frame 59 being similar to the frame 14 shown in FIG. 1. It should be understood that the means for mounting the standoff 40 onto a frame as described below is but one embodiment of the invention, and alternatives as detailed below also fall within the scope of the invention.

Figure 4:
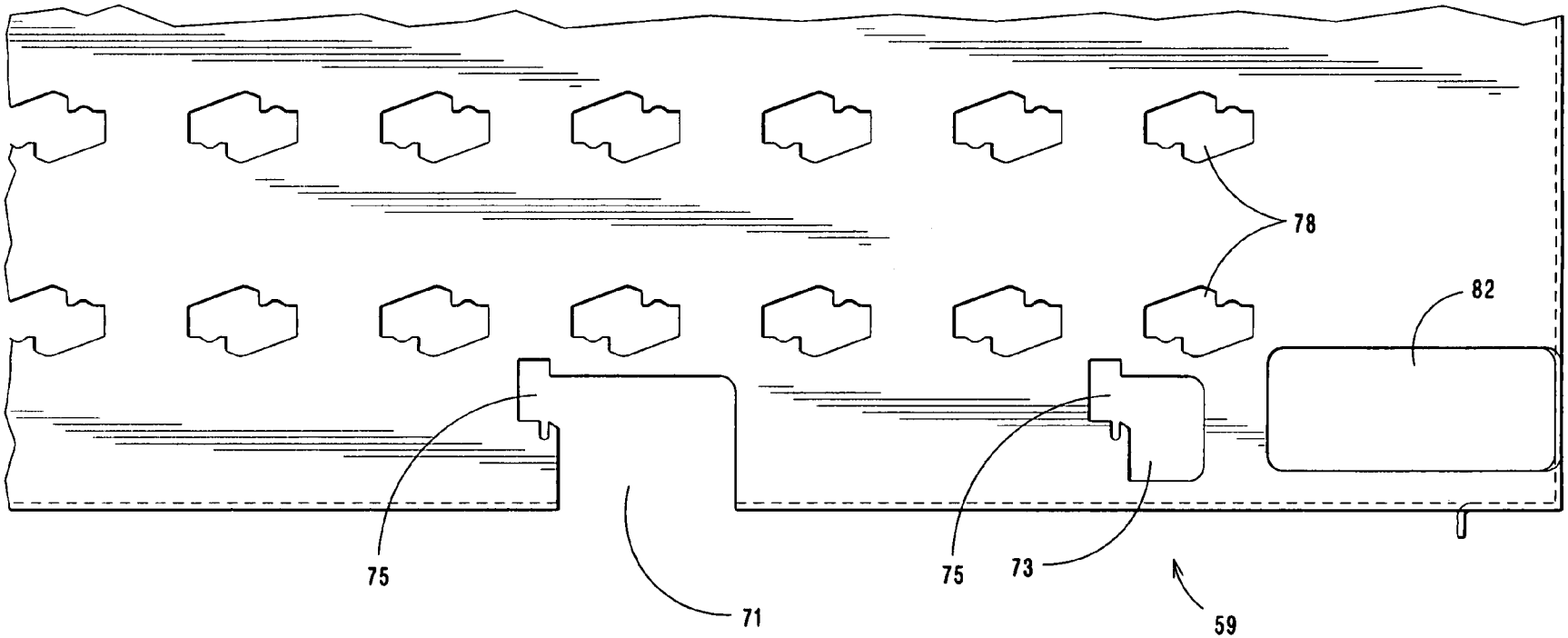
FIG. 4 is a plan view of a portion of a frame configured for standoff mounting.
Figure 5:
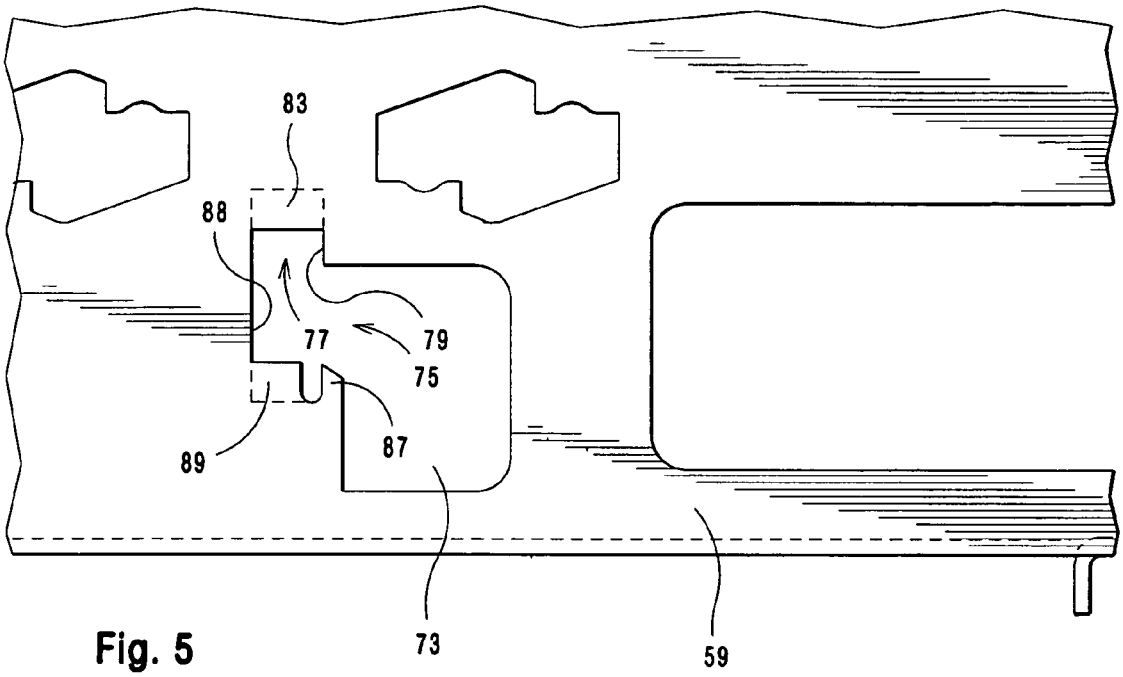
FIG. 5 is an enlarged view of a portion of the frame of FIG. 4 showing greater detail.

In one preferred mode, the standoff 40 is configured with slots to engage a specially configured metal frame to keep it in place. Turning to FIGS. 4 and 5, FIG. 4 shows a larger segment of the frame shown in FIG. 3 and FIG. 5 shows an enlarged part of the frame of FIG. 4. The frame 59 has a pair of cutouts 71 and 73. The frame 59 also depicts cutouts 78, which allow for mounting of the support insulators for coil retention, and a cutout 82 for terminal block mounting. Since the manner in which the support insulators and terminal block are mounted to the frame is well known, a further description of this aspect of the frame is not deemed necessary for understanding of the invention.

The cutout 71 serves two purposes; it allows for mounting of the standoff 40 and creates a space for the crossover portion of the heating element. Cutout 73 does not require a crossover and needs to be sized just to allow the standoff to be mounted to the frame 59. Each of the cutouts 71, 73 is configured the same for mounting of the standoff. Referring to FIG. 5, cutout 71 includes an entry zone 75 that allows the standoff to be first inserted into the cutout. One recess 77 is intended to receive an end of the standoff, with the recess forming an edge 79.

Referring now to FIGS. 2 and 5, the standoff body 41 has a slot 81, which is sized to engage the frame portion outlined at 83 (see FIG. 5). The standoff 40 includes another slot 85 opposed to slot 81 for attachment to another part of the frame 59 as detailed below.

When the standoff 40 is positioned within the cutout 73 for entry through zone 75, the standoff end containing the slot 81 is guided into the recess 77 such that the slot 81 is engaged by the frame portion 83. The standoff 40 is then rotated so that the slot 85 passes over tab 87 and frame portion outlined as 89. The sidewall of the standoff eventually contacts the edge 88 of the cutout 73, causing the standoff to come to rest. The tab 87 is then bent upward or downward, see FIG. 2 for an upward bend, to prevent the standoff slot 85 from being disengaged from frame portion 89.

Turning back to the slot 81, the recess 77 in the frame 59 and the slot 81 in the opposite end of the standoff 40 are sized so that the slot 81 engages sufficient frame to hold it in place The recess 77 is also sized so that its edge 79 abuts a portion of the sidewall of the standoff body 41, outlined as 91 in FIG. 2. This abutting engagement between the edge 79 and sidewall portion 91 keeps the standoff from rotating or moving once the slot 81 engages the frame portion 83.

To remove the standoff 40, the tab 87 would first be realigned with the plane of the frame 59. The standoff 40 can then be turned such that the slot 85 can be disengaged from frame portion 89, and the slot 81 can be disengaged from frame portion 83.

While the manner in which the standoff is mounted to the frame is only described for cutout 73, it should be understood that the same mounting arrangement and technique is employed for cutout 71. Further, while the frame 59 shows two cutouts for supporting the wire lead of a heating element, the heater could be the type wherein only one cutout and one standoff are required. Alternatively, the run or runs of the wire lead may be such that more than two cutouts and standoffs are required.

As part of the standoff mounting, the wire leads 53, see FIG. 3, are preferably first inserted into the opposing slots 49 prior to mounting of the standoff 40 to the frame 59. In this regard, cutout 73 is provided with an ample opening so that there is sufficient room to maneuver the standoff in a position to engage the wire lead 53 and slot 49 without having to move the wire lead any substantial distance for slot engagement.

While the standoff is shown mounted to the frame using a particular cutout configuration in the frame, and slots in the standoff body, other ways as would be within the skill of the art could be employed to mount the standoff to the frame. For example, the standoff could be mounted with fasteners, other shaped slotted arrangements, adhesives, snap fittings, or one or more combinations of these techniques. In one mode, the standoff could be formed with flanges instead of slots, wherein the flanges would extend from the standoff body. Fasteners such as screws or rivets, adhesives, or other attaching techniques could be employed to secure the flanges to the frame, with the flanges configured appropriately depending on the mounting technique, e.g., fasteners with preformed throughholes when using fasteners.

Figure 6:
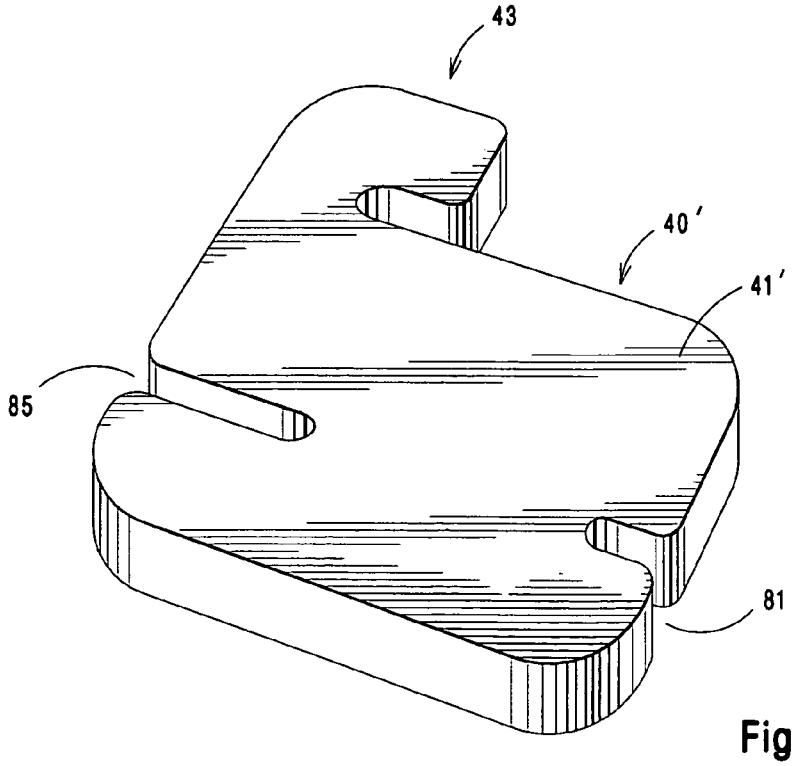
FIG. 6 is an alternative embodiment of the standoff of FIG. 2.

It should also be understood that the standoff 40 of FIG. 2 is designed to support a wire lead on both sides of the frame 59 since a pair of L-shaped arms 43 are utilized. In this mode, and referring back to FIG. 1, such a standoff would be used to support each of wire leads 32 and 34. However, in other instances, the standoff could be made with only one slot 49 with the body sized to still retain slots 81 and 85 for mounting purposes, but without the other L-shaped arm. FIG. 6 shows this embodiment by reference numeral 40' wherein the standoff body 41' is sized to accommodate the slots 81 and 85 without the need for the presence of the other L-shaped arm 43.

The standoff mounting arrangement described in FIGS. 3–5 is intended for a two-stage heater such as that disclosed in U.S. Pat. No. 5,925,273, but it is not so limited. That is, the standoff could be used in a single stage open coil heater wherein the wire lead extending between the coil and the terminal connection for one heating element, bare or insulated, require support, or any other heater that would have excessive runs of wire leads that require support.

Figure 7:
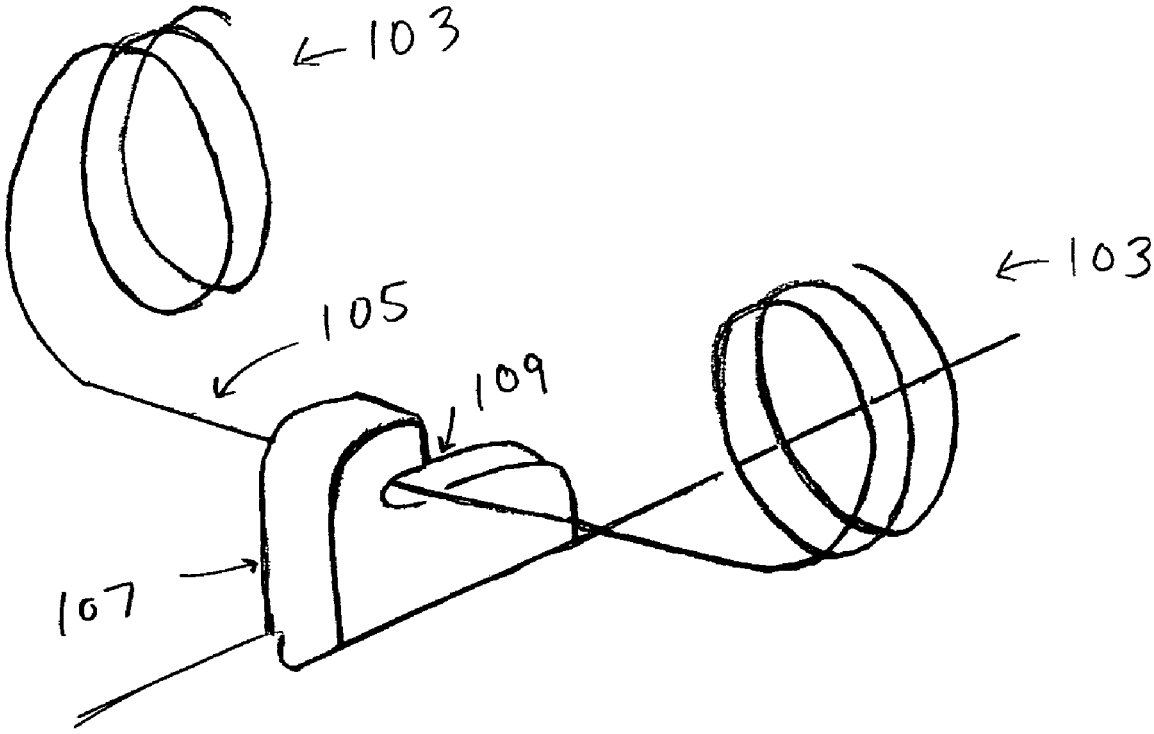
FIG. 7 is a schematic of yet another embodiment wherein the standoff supports an uncoiled portion of resistance wire.

While the invention has been described to support the uncoiled portions of the resistance wire heating element that functioned as the wire leads, the standoff can be used to support other uncoiled wire runs of a heater. A particular heater may have a run of wire that does not terminate at a terminal block or like, but still needs support for the length of the run. In this situation, the standoff could be mounted to the frame in such a position that its slot can support the uncoiled wire run. The run may involve a lengthy crossover that may need support to prevent shorting or a run between adjacent coils. FIG. 7 illustrates an example wherein a pair of coils, 101 and 103, are mounted on a frame (mounting not shown), with a run of uncoiled wire 105 extending between the coil. Because of the configuration of the heater, the run 105 requires support and a standoff 107 is used to support the run 105 via slot 109. The standoff can be mounted to the frame (not shown) in any of the manners described above.

As noted above, the method of heating using the inventive standoff in a heater can include methods wherein the wire resistance element is used in forced convection heating that employs air as the convective fluid passing over the wire. Alternatively, the resistance wire element can be used for radiant heating or free or natural convection heating.

As such, an invention has been disclosed in terms of preferred embodiments thereof which fulfills each and every one of the objects of the present invention as set forth above and provides a new and improved standoff-containing open coil resistance heater, the standoff itself, and a method of heating.

Of course, various changes, modifications and alterations from the teachings of the present invention may be contemplated by those skilled in the art without departing from the intended spirit and scope thereof. It is intended that the present invention only be limited by the terms of the appended claims.

What is claimed is:

1. In an open coil electric resistance heater having at least one resistance wire element for heating, a coiled portion of the resistance wire element being supported by a plurality of insulators, with the plurality of insulators being supported by a frame, the improvement comprising at least one standoff made of electrically insulating material, the at least one standoff further comprising a standoff body including means for mounting the body to the frame, the standoff body having at least one slot sized to engage and support a portion of the at least one run of uncoiled wire, wherein the coiled portion of the resistance wire element terminates in at least one run of uncoiled wire lead for connection to a source of power, the uncoiled wire lead being supported by the at least one slot.

2. The heater of claim 1, wherein the coiled portion of the resistance wire element terminates in a pair of runs of uncoiled wire leads, the standoff body having a pair of slots for supporting each of the runs of the uncoiled wire leads.

3. The heater of claim 2, wherein each run of uncoiled wire lead includes a portion surrounded by an insulator, each slot of the standoff being sized to supporting either bare uncoiled wire lead adjacent to the insulator or a portion of the insulator.

4. The heater of claim 1, wherein the heater is a two-stage heater having a pair of electric resistance elements for heating, the at least one standoff supporting a portion of at least one of the runs of uncoiled wire lead for one of the electric resistance elements.

5. The heater of claim 4, wherein the standoff body has a pair of slots for supporting each of the runs of the uncoiled wire leads of the one electric resistance element.

6. The heater of claim 1, further comprising a pair of standoffs mounted to the frame for supporting respective portions of the at least one run of uncoiled wire lead.

7. The heater of claim 6, wherein the heater has a pair of runs of uncoiled wire leads, with each standoff body having a pair of slots for supporting each of the runs of the uncoiled wire leads.

8. The heater of claim 1, wherein the at least one run of uncoiled wire lead includes one or more portions surrounded by an insulator, the slot of the standoff being sized for supporting either bare uncoiled wire lead adjacent to the insulator or a portion of the insulator.

9. The heater of claim 1, wherein the means for mounting further comprises a pair of opposing slots in the standoff body, and a cutout in the frame, each slot engaging a respective portion of the frame adjacent the cutout for mounting, a portion of the frame including a tab adjacent to one of the respective portions of the frame, bending of the tab retaining the standoff in the cutout.

10. The heater of claim 9, further comprising a pair of standoffs, and first and second cutouts in the frame for respective mounting of each standoff.

11. The heater of claim 10, wherein the first cutout is sized to allow for rotation of the standoff, for mounting to the frame and for a crossover wire of the resistance wire element, and the second cutout is sized to allow for rotation of the standoff and for mounting to the frame.

12. The heater of claim 9, wherein the cutout is sized to allow for rotation of the standoff and for mounting of the standoff to the frame.

13. In an open coil two stage electric resistance heater having a pair of resistance wire elements for heating, a coiled portion of each resistance wire element being supported by a plurality of insulators, with the plurality of insulators being supported by a frame, the improvement comprising at least one standoff, the at least one standoff made of electrically insulating material and further comprising a standoff body including means for mounting the body to the frame, the standoff body having opposing slots, each opposing slot sized to engage and support a bare wire portion of one of the pair of runs of uncoiled wire lead of one of the resistance wire elements, wherein the coiled portion of each resistance wire element terminates in at least one run of uncoiled and partially insulated wire lead for connection to a source of power, the uncoiled and partially insulated wire leads being supported respectively by the opposing slots.

14. The heater of claim 13, further comprising a pair of standoffs for supporting the pair of runs of uncoiled wire lead.

15. An uncoiled electric resistance wire standoff comprising a standoff body made of an electrically insulating material, the standoff body further comprising:

a pair of opposing first slots, each of the first slots having opposing parallel faces, a center of the first slots lying in a plane and adapted for mounting the standoff body to a heater frame, and at least one second slot formed in the standoff body, the at least one second slot having opposing parallel faces extending from a slot end face to an open end of the slot, the opposing parallel faces of the at least one second slot being generally parallel to the opposing faces of the first slots, the second slot adapted to support a portion of an uncoiled wire of an open coil electric resistance heater.

16. The standoff of claim 15, wherein the standoff body has two second slots, each sized to engage one of a pair of uncoiled wires of an open coil electric resistance heater.

17. The standoff of claim 15, wherein the second slot is formed by an L-shaped arm extending from a side face of the standoff body, a portion of the L-shaped arm and the side face forming the second slot.

18. The standoff of claim 17, wherein the standoff body has a pair of opposing L-shaped arms to form a pair of the second slots to engage a pair of runs of uncoiled wire.

19. The standoff of claim 15, wherein the at least one first slot is sized to engage an insulated resistance wire.

20. In a method of heating using an open coil electric resistance heater, wherein the heater has at least one resistance wire element for heating, a coiled portion of the resistance wire element being supported by a plurality of insulators, with the plurality of insulators being supported by a frame, the at least one resistance wire element including at least one run of uncoiled wire portion, the at least one resistance wire element being energized to generate heat, the improvement comprising supporting the at least one uncoiled wire portion using at least one standoff made of an electrically insulating material that is mounted to the frame and positioned between the uncoiled portion and the frame.

21. The method of claim 20, wherein the uncoiled wire portion extends from a terminal end of the coiled portion of the resistance wire element to a terminal block, the standoff being positioned between the terminal end and the terminal block for supporting the uncoiled wire portion.

22. The method of claim 21, wherein the heating is either radiant or convection heating.

* * * * *